US010206513B2

(12) United States Patent
Brueske

(10) Patent No.: US 10,206,513 B2
(45) Date of Patent: Feb. 19, 2019

(54) PIECE OF SEATING FURNITURE HAVING A BACKWARD-TILT STOP

(71) Applicant: INTERSTUHL BUEROMOEBEL GMBH & CO. KG, Messstetten (DE)

(72) Inventor: Joachim Brueske, Berlin (DE)

(73) Assignee: INTERSTUHL BUEROMOEBEL GMBH & CO. KG, Messstetten (DE)

( * ) Notice: Subject to any disclaimer, the term of this patent is extended or adjusted under 35 U.S.C. 154(b) by 148 days.

(21) Appl. No.: 15/429,407

(22) Filed: Feb. 10, 2017

(65) Prior Publication Data

US 2017/0231394 A1 Aug. 17, 2017

(30) Foreign Application Priority Data

Feb. 15, 2016 (DE) ..... 10 2016 102 557

(51) Int. Cl.

| | |
|---|---|
| ***B60N 2/00*** | (2006.01) |
| ***A47C 7/40*** | (2006.01) |
| ***A47C 7/00*** | (2006.01) |
| ***A47C 1/032*** | (2006.01) |

(52) U.S. Cl.

CPC ..... *A47C 7/40* (2013.01); *A47C 1/03205* (2013.01); *A47C 1/03277* (2013.01); *A47C 7/004* (2013.01); *A47C 7/006* (2013.01)

(58) Field of Classification Search

CPC . A47C 1/03205; A47C 1/032; A47C 1/03255; A47C 3/20; A47C 3/40; A47C 3/026; A47C 9/002; A47C 7/402; A47C 13/00; A47C 7/40; A47C 1/03277; A47C 7/004; A47C 7/006

USPC ..... 297/344.26, 344.25, 292, 344.19, 302.1, 297/303.1, 329, 383, 353; 248/418, 415

See application file for complete search history.

(56) References Cited

U.S. PATENT DOCUMENTS

| | | | | |
|---|---|---|---|---|
| 3,185,430 | A | 5/1965 | Bernard | |
| 3,455,601 | A | 7/1969 | Lie | |
| 5,577,807 | A * | 11/1996 | Hodge | A47C 1/023 297/300.8 |
| 5,678,886 | A * | 10/1997 | Infanti | A47C 9/00 248/500 |
| 5,897,166 | A * | 4/1999 | Tsai | A47C 7/402 297/353 |
| RE36,335 | E | 10/1999 | Perry | |
| 6,276,755 | B1 * | 8/2001 | Su | A47C 1/03255 297/285 |
| 6,279,864 | B1 * | 8/2001 | Carnahan | A47C 3/30 248/415 |
| 8,113,586 | B2 * | 2/2012 | Chen | A47C 1/026 297/301.1 |

(Continued)

FOREIGN PATENT DOCUMENTS

| | | |
|---|---|---|
| DE | 1938204 | 5/1966 |
| DE | 2319846 | 10/1974 |

(Continued)

*Primary Examiner* — Chi Q Nguyen

(74) *Attorney, Agent, or Firm* — Collard & Roe, P.C.

(57) ABSTRACT

A piece of seating furniture includes a backrest and a seat. The seat is operatively connected to the backrest. The backrest and the seat, during a pivoting of the backrest, open one another at an opening angle. A backward-tilt stop is included for limiting relative movement of the seat and the backrest. The backward-tilt stop is situated in extension of a vertical support of a pedestal.

7 Claims, 4 Drawing Sheets

(56) References Cited

U.S. PATENT DOCUMENTS

| | | | | |
|---|---|---|---|---|
| 9,332,851 | B2 | 5/2016 | Machael et al. | |
| 9,458,905 | B2 * | 10/2016 | Battey | F16F 1/041 |
| 9,504,325 | B2 | 11/2016 | Sander et al. | |
| 10,016,061 | B2 * | 7/2018 | Brueske | A47C 7/004 |
| 2004/0075321 | A1 * | 4/2004 | Sangiorgio | A47C 1/03255 297/300.1 |
| 2004/0080197 | A1 | 4/2004 | Kopetzky | |
| 2005/0179288 | A1 * | 8/2005 | Lizaso | A47C 1/12 297/250.1 |
| 2006/0097558 | A1 | 5/2006 | Aubert | |
| 2006/0138829 | A1 | 6/2006 | Kopetzky | |
| 2006/0138840 | A1 * | 6/2006 | Keilhauer | A47C 3/02 297/344.1 |
| 2007/0108819 | A1 | 5/2007 | Ueda | |

FOREIGN PATENT DOCUMENTS

| | | |
|---|---|---|
| DE | 7631908 | 4/1978 |
| DE | 3724605 | 2/1989 |
| DE | 69129628 | 10/1998 |
| DE | 20316384 | 3/2004 |
| DE | 102004053965 | 5/2006 |
| DE | 60313010 | 12/2007 |
| DE | 102011104972 | 12/2012 |
| WO | WO 2013083562 | 6/2013 |

* cited by examiner

PIECE OF SEATING FURNITURE HAVING A BACKWARD-TILT STOP

CROSS-REFERENCE TO A RELATED APPLICATION

The invention described and claimed hereinbelow also is described in German Patent Application 10 2016 102 557.7, filed on Feb. 15, 2016. The subject matter of the German Patent Application is incorporated herein by reference and, provides the basis for a claim of priority of invention under 35 U.S.C. 119(a)-(d).

BACKGROUND OF THE INVENTION

The present invention relates to a piece of seating furniture formed with a backrest and a seat. The seat is operatively connected to the backrest so that the backrest and the seat, during the pivoting of the backrest, open one another at an opening angle; a backward-tilt stop is provided, which is designed for limiting the relative movement of the seat and the backrest.

Such a piece of seating furniture is known from WO 2013/083562 A1, for example. The known piece of seating furniture comprises a backrest and a seat surface. The seat surface is operatively connected to the backrest in reliance upon an integrally formed connection element. The connection element is connected to the backrest and the seat surface and is designed to counteract a pivoting movement of the backrest in a resilient manner. That is, the connection element is designed to pivot along with the seat surface in a predetermined manner in relation to the pivoting movement of the backrest, and therefore the backrest and the seat surface, during the pivoting of the backrest, open one another at an opening angle. A seat leg rests against a backward-tilt stop in the area of an end which faces away from a turning section.

The backward-tilt stop in the known piece of seating furniture operates in such a way that upon deflection against a spring element which rests against a base support, the backward-tilt stop limits the spring travel of the seat leg and the backrest leg upon deflection which is caused, for example, by the seat surface being sat upon by a person. The backward-tilt stop is situated next to a vertical support of a pedestal. Unfavorable leverage ratios arise as a result.

SUMMARY OF THE INVENTION

The present invention overcomes shortcomings of known arts, such as those mentioned above.

The present invention improves or refines a piece of seating furniture of the known type in such a way that the leverage ratios present during the limitation of the opening movement of the seat surface with respect to the backrest are improved.

In one inventive embodiment, for example, the piece of seating furniture is formed with a backrest and a seat, wherein the seat is operatively connected to the backrest such that the backrest and the seat, during the pivoting of the backrest, open one another at an opening angle. The inventive piece of seating furniture includes backward-tilt stop designed for limiting the relative movement of the seat and the backrest. The backward-tilt stop is situated in extension of the vertical support of a pedestal. Due to this measure, the backward-tilt stop is located in the center above a pedestal. Forces that act on the seat therefore well absorbed during use of the piece of seating furniture.

In the embodiment, the backward-tilt stop is directly or indirectly connected to the vertical support of the pedestal, e.g., via a base support. In addition, the backward-tilt stop is indirectly or directly connected, via its other end, to the seat. For example, the backward-tilt stop can be connected via its seat-side end to a seat leg of a seat leaf spring. The seat leg, in turn, can be connected to the seat and, optionally, to a base support.

In an embodiment, the backward-tilt stop is blockable. If the backward-tilt stop is blocked, no relative movement of the seat with respect to the vertical support of the pedestal is possible. This also means, however, that no relative movement of the backrest with respect to the seat is possible. Due to the blockage of the backward-tilt stop, the relative movement of the seat and the backrest are therefore also blocked.

Further advantages result when the backward-tilt stop comprises a variable-length section. Due to the variable-length section, relative movements of the seat with respect to the vertical support of the pedestal are possible. A pivoting movement between the backrest and the seat is therefore also made possible.

The backward-tilt stop can comprise a stop shaft and a stop piston, wherein, in a first relative rotary position of the stop shaft and the stop piston, these are movable relative to one another in the longitudinal direction and, in a second relative rotary position, the stop shaft and the stop piston are not movable relative to one another in the longitudinal direction. The backward-tilt stop can therefore be blocked in a simple manner by way of a rotation of the stop shaft and the stop piston relative to one another. The stop piston can be guided via stems in recesses of the stop shaft. By way of a relative rotation of the stop shaft and the stop piston, the stems of the stop piston come to rest next to the recesses, and therefore mutual guidance is no longer possible and relative movement in the longitudinal direction is no longer possible.

An actuating mechanism is provided for blocking and releasing the backward-tilt stop. The relative rotation of the stop shaft and the stop piston is effectuated by use of the actuating mechanism. The actuating mechanism may include a release button on the underside of the seat. The release button can be connected to the backward-tilt stop, for example, via a cable pull.

Further advantages result when the backward-tilt stop is pivotable relative to the seat, for example, when the backward-tilt stop is connected to the seat via a spherical or hemispherical connection element. The backward-tilt stop can be pivotable relative to the seat not only along one direction, but rather pivotable relative to the seat on all sides. Thus, it is possible to assume a plurality of seat positions. These seat positions are not restricted or prevented by the backward-tilt stop.

In addition, the backward-tilt stop can be situated to be pivotable relative to a pedestal. Therefore, one further degree of freedom results and the backward-tilt stop can follow movements of the seat.

The seat can be connected to a backrest leg via a seat bearing, enabling the seat to rest on a backrest leg. Given that the connection is established via a seat bearing, relative movements of the seat and the backrest leg are possible, however. Advantages result when the seat bearing is designed as a spherical bearing. A plurality of positions of the seat relative to a horizontal plane is therefore possible.

It is understood that the features mentioned above and which are described in the following may be used not only in the combination described, but also in other combinations or alone, without departing from the scope of the present disclosure.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
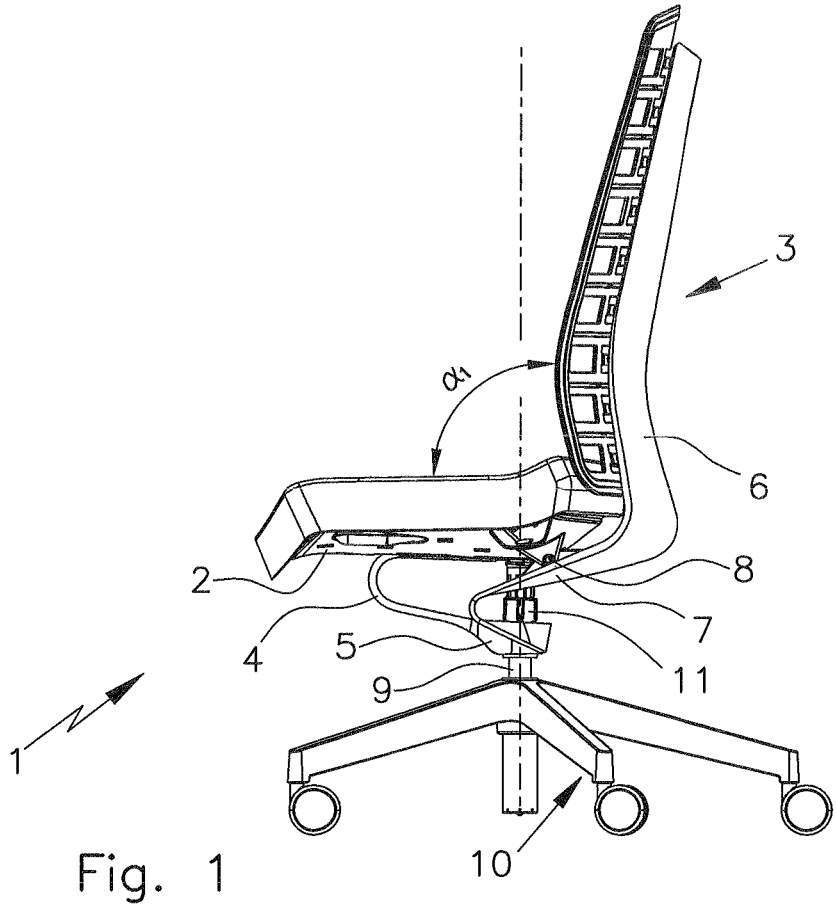
FIG. 1 shows a side view of a piece of seating furniture constructed according to the invention, in a first relative position of the seat and the backrest.

FIG. 1 shows a piece of seating furniture 1 designed as an office chair, comprising a seat 2 and a backrest 3. The seat 2 is situated on a flexible seat support 4. The support 4 is essentially U-shaped in cross section and is connected to a base support 5. The backrest 3 comprises a support structure 6 which has a flexible backrest leg 7 that is likewise connected to the base support 5. The seat 2 is connected to the support structure 6, i.e., the backrest 3, via a seat bearing 8. A backward-tilt stop 11 is situated between the seat 2 and the vertical support 9 of a pedestal 10. In the position shown, the seat 2 and the backrest 3 have a home position relative to one another, which corresponds to an angle $\alpha 1$.

Figure 2:
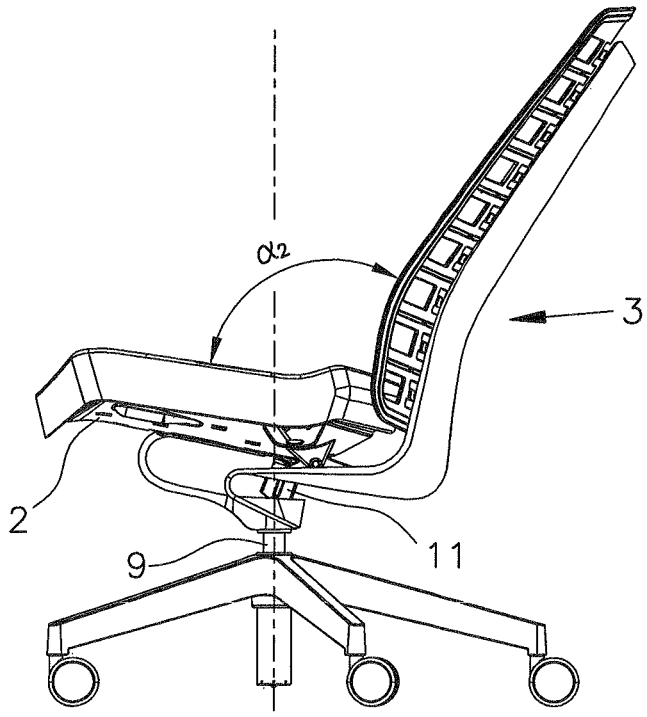
FIG. 2 shows a side view of the piece of seating furniture constructed according to the invention, with pivoted backrest and seat.

FIG. 2, in turn, shows the piece of seating furniture 1, wherein the backrest 3 and the seat 2 have been pivoted in this case. Thus, the opening angle between the backrest 3 and the seat 2 has also increased and now corresponds to the angle $\alpha 2$. The backward-tilt stop 11, which is located in extension of the vertical support 9, has been pivoted and compressed, i.e., the length was shortened. In the position shown in FIG. 2, the backward-tilt stop 11 is completely compressed, and therefore a further pivoting of both the seat 2 and the backrest 3 is no longer possible. The backward-tilt stop 11 therefore limits the movement of the backrest 3 and the seat 2.

Figure 3:
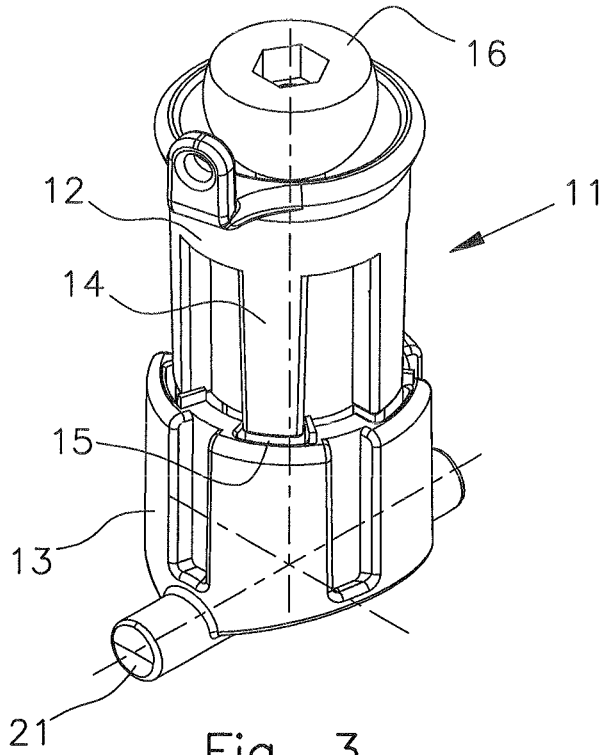
FIG. 3 shows a backward-tilt stop in the released position.

A detailed illustration of the backward-tilt stop 11 is shown in FIG. 3. The backward-tilt stop 11 comprises a stop piston 12 and a stop shaft 13. The stop piston 12 comprises stems 14 which, in the position shown, align with groove-like recesses 15 in the stop shaft 13. Therefore, the stop piston 12 and the stop shaft 13 can be moved relative to one another, wherein the stems 14 are guided through the groove-like recesses 15.

Figure 4:
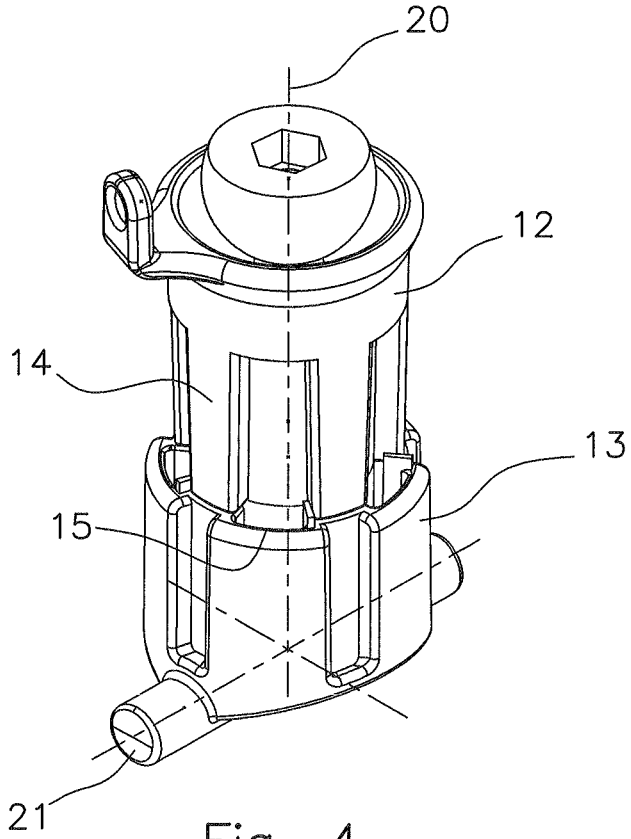
FIG. 4 shows the backward-tilt stop in the locked or blocked position.

At the upper end, the backward-tilt stop 11 comprises a hemispherical connection piece 16, via which the backward-tilt stop 11 can be pivotably connected to the seat 2. The backward-tilt stop 11 is shown in a released position in FIG. 3. FIG. 4 shows the blocked position, however. As compared to the position shown in FIG. 3, the stop piston 12 has been rotated so far in the clockwise direction with respect to the stop shaft 13 that the stems 14 are located next to the groove-like recesses 15. The stems 14 therefore rest on the stop shaft 13. A relative movement, in the longitudinal direction 20, of the stop piston 12 and the stop shaft 13 is therefore not possible.

It is clear from both FIG. 3 and FIG. 4 that the backward-tilt stop 11 has a pivot axis 21 at its lower end, which enables a pivoting of the backward-tilt stop 11 relative to the pedestal 10.

Figure 5:
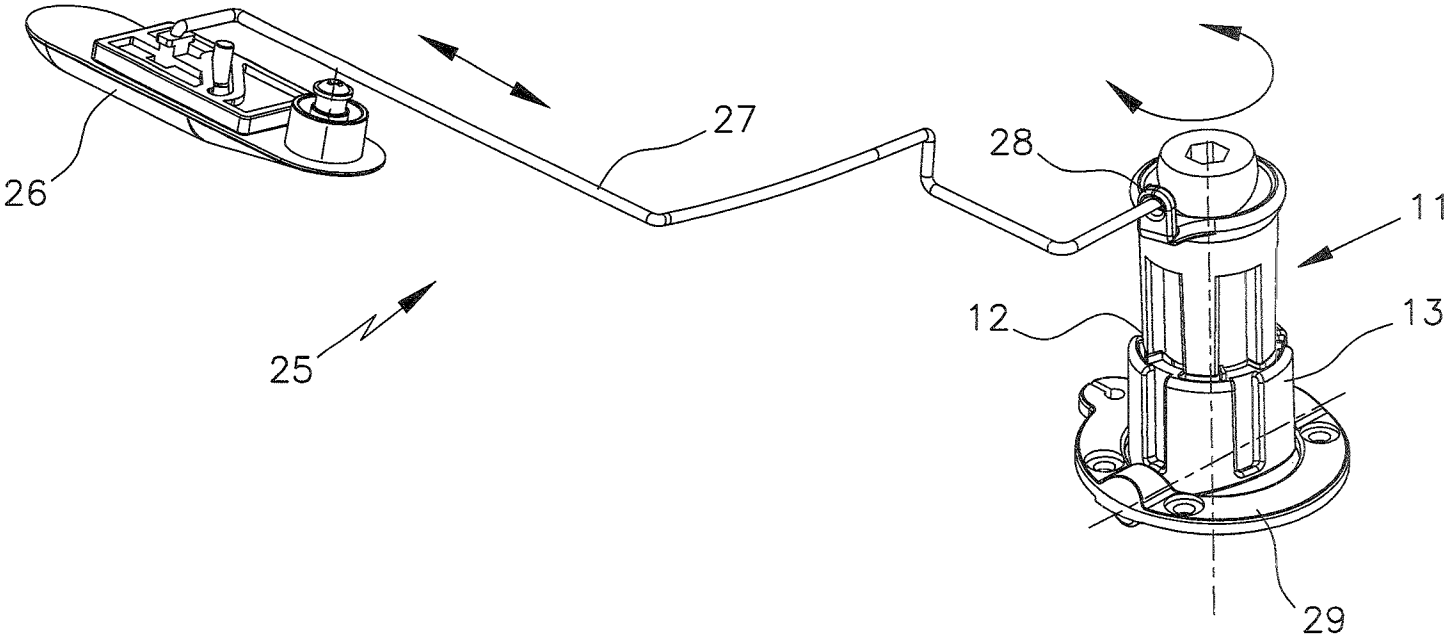
FIG. 5 shows an actuating mechanism.

FIG. 5 shows an actuating mechanism 25 comprising an actuating button 26 which can be situated on the seat 2 on its underside. A cable pull 27, for example, a trigger wire, extends from the actuating button 26 to an actuating tab 28 on the stop piston 12. The stop piston 12 can therefore be rotated relative to the stop shaft 13 by actuating the button 26. A base plate 29, by which the backward-tilt stop 11 can be fastened on the base support 5, is also apparent.

Figure 6:
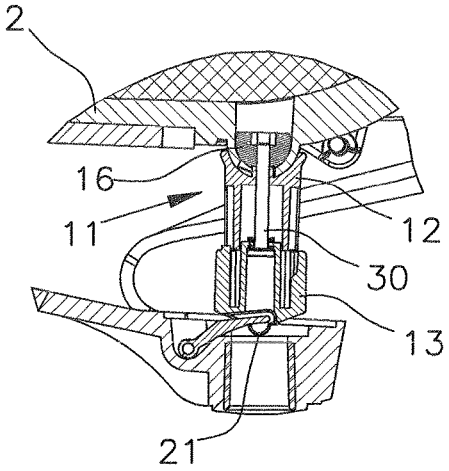
FIG. 6 shows an enlarged sectional illustration of the backward-tilt stop in a home position of the piece of seating furniture.
Figure 7:
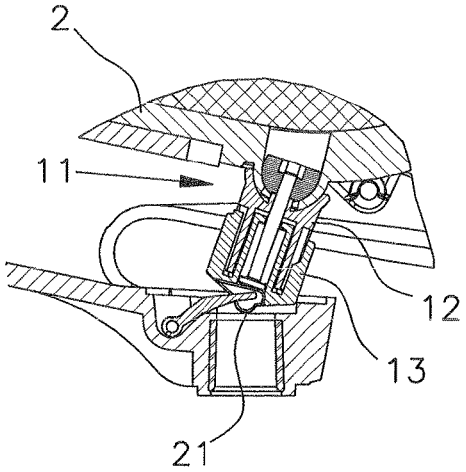
FIG. 7 shows an illustration of the backward-tilt stop corresponding to FIG. 6, with pivoted backrest and seat.

FIG. 6 shows a cut detailed illustration of the piece of seating furniture 1 in an area of the backward-tilt stop 11. In the position shown, the backward-tilt stop 11 is released, i.e., not blocked. This means that the stop piston 12 is movable relative to the stop shaft 13, for example, movable downward in the exemplary embodiment shown. The backward-tilt stop 11 further comprises a stop axle 30, on the end of which the hemispherical connection piece 16 is situated. The connection piece 16 is mounted in the seat 2. The position shown in FIG. 6 corresponds to the home position. If the seat 2 is now pivoted, the situation shown in FIG. 7 results. In this case, it is apparent that the backward-tilt stop 11 has been pivoted about the axis 21. It is also apparent that the backward-tilt stop 11 has been compressed, i.e., the stop piston 12 has been displaced in the stop shaft 13 and, there, assumes an end position. A further compression or change in length in the longitudinal direction of the backward-tilt stop 11 is not possible. The backward-tilt movement of both the seat 2 and of the backrest 3 is therefore limited. It also is apparent that the seat 2 has been pivoted relative to the backward-tilt stop 11 as compared to the position according to FIG. 6. This is possible since the hemispherical connection piece 16 is provided.

Figure 8:
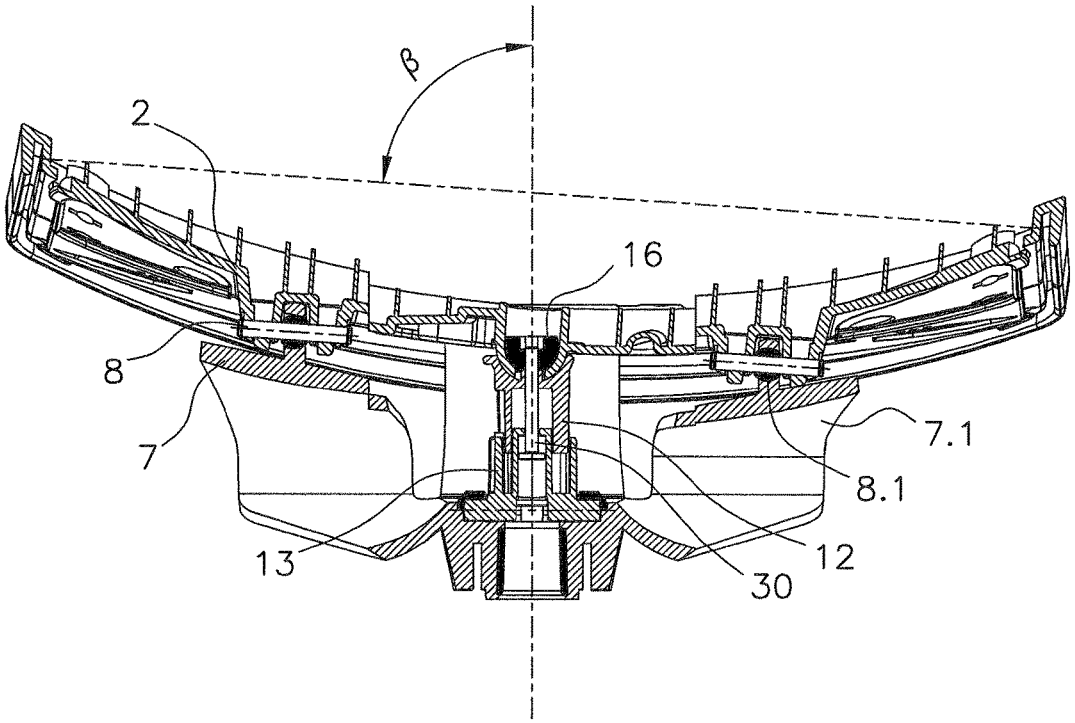
FIG. 8 shows a sectional illustration of the seat in an area of the backward-tilt stop.

FIG. 8 shows a partial sectional illustration through the seat 2. It is apparent here that the seat 2 is laterally pivotable, and therefore said seat assumes an angle $\beta \neq 90°$ with respect to vertical. This pivoting movement is possible, on the one hand, since the hemispherical connection piece 16 is provided and, therefore, the backward-tilt stop 11 does not impede the movement. On the other hand, the movement is made possible by the fact that the backrest leg 7 is connected via the seat bearing 8, which is designed as a spherical bearing, and therefore the seat 2 can carry out the movement shown. A second seat bearing 8.1 connects a second backrest leg 7.1 to the seat 2.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A piece of seating furniture, comprising:

a backrest;

a seat;

a pedestal with a vertical support; and a backward-tilt stop arranged between the vertical support and the seat; and an actuating mechanism for blocking and releasing the backward-tilt stop;

wherein the seat is operatively connected to the backrest;

wherein the backrest and the seat are configured to pivot relative to one another;

wherein during a pivoting of the backrest and the seat, an opening between the backrest and the seat is determined by relative movement therebetween, and has an opening angle; and wherein the backward-tilt stop operates to limit the relative movement of the seat and the backrest, when the backward-tilt stop is in extension of the vertical support of the pedestal.

2. The piece of seating furniture according to claim 1, wherein the backward-tilt stop comprises a variable-length section.

3. The piece of seating furniture according to claim 1, wherein the backward-tilt stop comprises a stop shaft and a stop piston; wherein, in a first relative rotary position of the stop shaft and the stop piston, the stop shaft and the stop piston are movable relative to one another in a longitudinal direction; and wherein, in a second relative rotary position, the stop shaft and the stop piston are not movable relative to one another in the longitudinal direction.

4. The piece of seating furniture according to claim 1, wherein the backward-tilt stop is connected to the seat via a spherical or hemispherical connection element, and therefore pivotable relative to the seat.

5. The piece of seating furniture according to claim 1, wherein the backward-tilt stop is pivotable relative to the pedestal.

6. The piece of seating furniture according to claim 1, wherein the seat is connected to a backrest leg via a seat bearing.

7. The piece of seating furniture according to claim 6, wherein the seat bearing is designed as a spherical bearing.

* * * * *